US005455062A

United States Patent [19]

Mühlfriedal et al.

[11] Patent Number: 5,455,062

[45] Date of Patent: Oct. 3, 1995

[54] CAPILLARY DEVICE FOR LACQUERING OR COATING PLATES OR DISKS

[75] Inventors: Eberhard Mühlfriedal, Maulbronn; Armin Kübelbeck, Bensheim; Torsten Gerisch, Karlsruhe; Karl Appich, Sternenfels; Jakob Szekeresch, Pforzheim; Martin Kallis, Mühlacker, all of Germany

[73] Assignee: Steag Microtech GmbH Sternenfels, Sternenfels, Germany

[21] Appl. No.: 372,878

[22] Filed: Jan. 13, 1995

Related U.S. Application Data

[63] Continuation of Ser. No. 144,787, Oct. 29, 1993, abandoned, which is a continuation-in-part of Ser. No. 66,107, May 28, 1992, abandoned.

[51] Int. Cl.[6] ..... B05D 1/26; B05D 1/40

[52] U.S. Cl. ..... 427/8; 427/11; 427/443.2; 118/401; 118/407; 118/423

[58] Field of Search ..... 118/401, 407, 118/423; 427/8, 11, 443.2

[56] References Cited

U.S. PATENT DOCUMENTS

| | | | |
|---|---|---|---|
| 2,046,596 | 7/1936 | Zwiebel | 91/43 |
| 2,649,756 | 8/1953 | Egee et al. | 118/401 |
| 2,937,108 | 5/1960 | Toye | 118/401 |
| 3,196,830 | 7/1965 | LeHovec | 118/401 |
| 3,201,275 | 8/1965 | Herrick | 118/401 |
| 4,370,356 | 1/1983 | Bok et al. | 427/38 |

FOREIGN PATENT DOCUMENTS

| | | |
|---|---|---|
| 1588295 | 3/1970 | France . |
| 3429335 | 2/1986 | Germany . |
| 4235770 | 8/1992 | Japan . |
| 2098510 | 11/1982 | United Kingdom . |

*Primary Examiner*—Shrive Beck
*Assistant Examiner*—Brian K. Talbot
*Attorney, Agent, or Firm*—Robert W. Becker & Associates

[57] ABSTRACT

A device for coating a plate has an open channel being open in an upward direction and a device for supplying a liquid to the open channel. The liquid in the open channel forms an convexly curved portion projecting upwardly from the open channel. A device for transporting a plate at a close distance past the open channel is provided, with which a surface to be coated of the plate facing the convexly curved portion of the liquid is guided such that a thin film of the liquid is deposited on the surface to be coated by adhesion effects. Another device for lacquering or coating plates or disks has a capillary slot that is filled with a liquid coating medium. The plate to be coated is advanced across the capillary slot with the surface to be coated facing downwardly so that due to the capillary effect a thin layer is deposited on the surface of the plate.

8 Claims, 4 Drawing Sheets

CAPILLARY DEVICE FOR LACQUERING OR COATING PLATES OR DISKS

This application is a continuation of application Ser. No. 08/144,787 filed Oct. 29, 1993, now abandoned which is a continuation-in-part of application Ser. No. 08/066,107 filed May 28, 1993, now abandoned.

BACKGROUND OF THE INVENTION

The present invention relates to a device for lacquering or coating of plates or disks with an open channel and, in particular, with an open channel that is narrowed to a capillary, especially for coating glass plates for LCD production.

In the field of thin layer technology, especially for the production of LCD monitors, masks for semi-conductor manufacture, semiconductor or ceramic substrates etc., the following problem is often encountered: Rectangular or round plates must be provided with a uniform layer of lacquer or other initially liquid media for color filters or special protective layers. With commonly known devices the plates are horizontally attached to a turntable. To the center point of the plate a certain amount of lacquer or liquid is dripped from above with a nozzle. Then the turntable is rotated. Due to centrifugal forces the liquid is distributed on the substrate during rotation. A large portion of the liquid is spun across the rim of the plate. The uniformness of the layer thickness that is to be achieved with this process depends on the magnitude of the rotation acceleration and speed.

Difficulties with respect to the uniformness of the lacquer thickness on rectangular plates result with the known processes especially in the area of the corners of the plate. In these areas commonly strips of greater or lesser lacquer thickness are observed which are concentric to the center of the substrate. This causes a substantial reduction in the uniformness of the lacquer thickness.

In order to collect the lacquer which is spun across the rim of the substrate, and also for protecting the lacquering station, such lacquering turntables are commonly mounted within some form of a container. It cannot be prevented that lacquer stains are also deposited on the lateral areas of the substrate. This is disadvantageous for the further processing of the substrate. Another disadvantage of the known method is that more than 90% of the lacquer used is spun over the rim of the plate. This excess lacquer cannot be reused and is thus lost. Furthermore, the entire construction and the drive of the turntable are complicated and expensive.

From German Offenlegungsschrift 40 21 621 an improvement of this lacquering and coating process is known. Here, the liquid is sprayed in the form of a flood onto the plate with a porous tube. It may be disadvantageous for the coating process that the liquid is altered in certain properties, for example, solvent content and viscosity, by the spraying process and the corresponding pumping action. Furthermore, it is required that the flow conditions are maintained constant in order to be able to achieve the uniformness of the layer thickness required for various applications.

It is therefore an object of the present invention to improve the known lacquering and coating devices and methods with respect to the aforementioned criteria.

DESCRIPTION OF PREFERRED EMBODIMENTS

This object, and other objects and advantages of the present invention, will appear more clearly from the following specification in conjunction with the accompanying drawings, in which.

SUMMARY OF THE INVENTION

Figure 1:
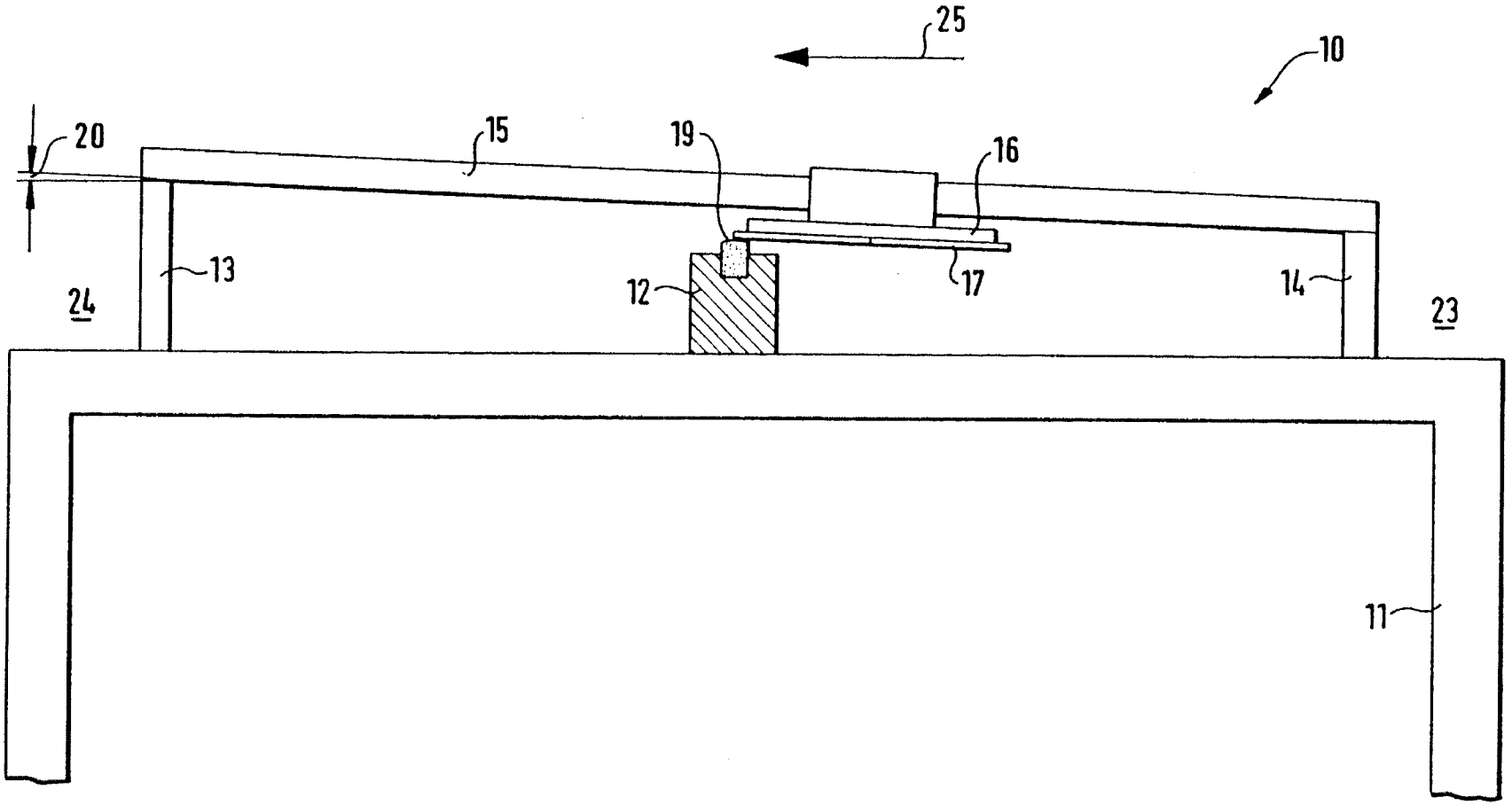
FIG. 1 shows a view of the construction of the inventive lacquering and coating device.

The device for coating a plate with an open channel according to the present invention is primarily characterized by: An open channel being open in an upward direction; a means for supplying a liquid to the open channel, wherein the liquid in the open channel forms an convexly curved portion projecting upwardly from the open channel; and a means for transporting a plate at a close distance past the open channel, with a surface to be coated of the plate facing the convexly curved portion of the liquid, such that a thin film of the liquid is deposited on the surface to be coated by adhesion effects.

Preferably, the plate is an angular plate with corners and is transported past the open channel with one of the corners leading.

Advantageously, the plate is transported past the channel at an angle greater than 0° relative to the horizontal.

The open channel expediently has a means for pivoting it relative to the horizontal.

The means for transporting is preferably a linear transporting device with an adjustable slant from which the plate is suspended with the surface to be coated facing in a downward direction.

Advantageously, the filling level of the open channel is maintained constant with the means for supplying a liquid. The means for supplying a liquid comprises a compensation tank and a supply container, wherein the filling level is maintained constant by hydrostatic pressure from the compensation tank and wherein the compensation tank is refilled by the supply container.

Advantageously, the device comprises an automatic loading station and an automatic unloading station for operating the device in a fully automated manner.

The present invention furthermore encompasses a method for coating a plate with an open channel, characterized primarily by the following steps:

a) arranging an open channel so as to be open in an upward direction;

b) supplying a liquid to the open channel, the liquid in the open channel forming a convexly curved portion projecting upwardly from the open channel;

c) positioning a plate to be coated with a surface to be coated in a downward direction;

d) guiding the plate at a close distance past the open channel with the surface to be coated facing the convexly curved portion of the liquid; and e) simultaneously depositing a thin film of the liquid on the surface to be coated by adhesion effects.

When the plate is an angular plate with corners, the plate is preferably advanced past the open channel with one of the corners leading.

The plate is preferably arranged at an angle greater than 0° relative to the horizontal during steps d) and e).

Advantageously, the open channel is pivoted relative to the horizontal into a slanted position.

Expediently, a linear transporting device with an adjustable slant is arranged above the open channel and the plate is suspended with the surface to be coated facing in a downward direction from the linear transporting device.

The filling level of the open channel is advantageously maintained constant. Preferably, the filling level is maintained constant by hydrostatic pressure from a compensation, tank and the compensation tank is refilled from a supply container.

In a direction of guiding the plate an automatic loading station is arranged upstream of the open channel and an automatic unloading station is arranged downstream of the open channel for performing the inventive method in a fully automated manner.

Accordingly, the plate is guided with the surface to be coated facing downward across the channel which is filled with a liquid to such an extent that a convexly curved portion is formed projecting upwardly from the channel. The surface of the plate is guided to the surface of the convexly curved portion of the liquid. Due to adhesion effects a thin liquid layer is deposited on the plate which, by linearly transporting the plate, is uniformly pulled over the entire plate surface. The plate in this coating process must not be rotated, and no liquid is lost. Furthermore, no problems with respect to the uniformness of the layer thickness on the plate corners, respectively, at the disk edges, result and the liquid must not be pumped. The invention is advantageously applicable, for example, for coating or lacquering of glass plates for LCD production. It is especially advantageous when respectively large plates are to be provided with a uniform liquid layer, for example, lacquer layer.

It has been shown to be especially advantageous to advance rectangular plates to the channel such that the liquid first comes into contact with one corner, thereby creating a point contact. This prevents that, due to linear flow resistance within the layer, flow strips of different liquid thickness will be distributed on the plate surface. Furthermore, the last contact between lacquer and plate, when the plate has completed its advance across the channel, is also in the form of a point. This prevents the formation of a bead which occurs when the last point of contact is linear.

The device, according to an advantageous embodiment, is designed such that the plate surface is not parallel to the surface of the channel, but is guided at a small angle of 1° to 45°, for example 2.5°. This results in an even more uniform flow on the plate surface which further extraordinarily favors and sustains a homogeneous layer on the plate.

It is advantageous to provide a pivotable support for the channel. Accordingly, the surface of the channel can be adjusted at varying angles relative to the horizontal. This allows for a bias of the shape of the convexly curved portion projecting upwardly from the channel. This is especially advantageous with respect to the adjustment of the device to various plate materials and surface properties. By changing the shape of the convexly curved portion, the adhesion behavior can be influenced and optimized.

Preferably, the device is used such that the plate with the surface to be coated is connected to a linear transport device with adjustable slant which Guides the plates at a uniform velocity across the convexly curved liquid portion. Advantageously, the linear transport device and the channel are connected to a common frame. With the respectively adjustable angles of the linear transport device and the channel relative to the horizontal a multitude of adjusting possibilities to various kinds of plates to be coated is possible.

A further advantageous embodiment of the invention is characterized by the filling level of the channel being maintained at a constant level during the coating process. For this purpose it is required that the same amount of liquid that is applied to the plate flows into the channel. This can be achieved, for example, by arranging next to the channel a compensation tank for supplying the channel. Before beginning the coating process, the filling level of this tank is adjusted such that a suitable convexly curved portion of the liquid is generated at the channel. When the liquid within the channel is consumed, more liquid is supplied from the compensation tank without a substantial time delay until the geodetical levels of the liquid columns within the channel and the compensation tank are equilibrated. With a suitable control, for example, a float valve essentially known from carburetors of vehicle engines, the filling level of the compensating tank is returned to the preadjusted level with liquid from an additional supply container. This is achieved with a certain time lag and thus results in a delay. The compensation tank thus ensures that the filling level within the channel does not drop too low before the time-delayed supply from the supply container takes place.

Advantageously, the inventive coating device is provided with an automatic loading and automatic unloading device so that the entire lacquering process is fully automated. This is necessary for adaptation to the manufacturing conditions, for example, for LCD and mask production and provides for a uniform and reproducible lacquering result for great produced quantities.

In an alternative embodiment, the device for coating a plate according to the present invention is primarily characterized by:

A capillary slot; and

Means for supplying the capillary slot with a liquid coating medium, wherein for a coating process a plate with a surface to be coated facing the capillary slot is advanced across the capillary slot such that a thin film of the liquid coating medium is deposited on the plate by a capillary effect and an adhesion effect.

Preferably, the means for supplying comprises a channel partially filled with the liquid coating medium, and the capillary slot is formed by two parallel plates immersed into the liquid coating medium contained in the channel.

The device further comprises a means for adjusting a distance between the parallel plates in an infinitely variable manner.

Preferably, after each coating process the distance between the parallel plates is enlarged to cancel the capillary effect and preserve the liquid coating medium.

Expediently, immediately before each coating process the distance between the parallel plates is decreased to a capillary width for pressing a small amount of the liquid coating medium out of the capillary slot to thereby start the coating process.

The device further comprises a holder and a means for moving the channel so that the coating process is performed with the holder being stationary and the channel being moved across the plate.

The device expediently comprises a loading device and an unloading device for operating the device fully automatically.

The preset invention further relates to an alternative method for coating a plate. The method is characterized by the following steps:

supplying a capillary slot with a liquid coating medium; and coating a plate by the following steps:

a) advancing a plate with a surface to be coated facing the capillary slot across the capillary slot; and b) depositing a thin film of the liquid coating medium on the plate by a capillary effect and an adhesion effect.

Advantageously, the method further comprises the steps of providing a channel and partially filling the channel with the liquid coating medium and furthermore arranging in the channel two parallel plates and immersing the two parallel plates in the liquid coating medium contained in the channel so that the two parallel plates define the capillary slot.

Preferably, according to the inventive method, after each step of coating, a distance between the parallel plates is enlarged to cancel the capillary effect and preserve the liquid coating medium.

The method may also comprise the step of, immediately before each step of coating, decreasing a distance between the parallel plates to a capillary width for pressing a small amount of the liquid coating medium out of the capillary slot to thereby start the step of coating.

Preferably, the method further comprises the steps of supporting the plate on a holder and moving the channel relative to the holder so that the step of coating is performed with the holder being stationary and the channel being moved across the plate.

The method further comprises the steps of operating automatically the step of supplying and the step of coating by providing a loading device and an unloading device.

Accordingly, with the present invention the plate with the surface to be coated facing downwardly is guided across the channel that is designed such that it acts as a capillary and thus supplies the liquid coating medium or lacquer automatically and with an especially uniform velocity. The capillary effect is achieved by providing a narrow slot which is less than 0.5 mm wide. Due to the capillary effect the lacquer or liquid coating medium advances automatically upwardly in the slot with a constant velocity against the force of gravity and exits at the upper end of the capillary slot. Above the slot the stream of lacquer contacts as a narrow line the plate surface to be coated and is deposited thereon.

It is advantageous to generate the capillary by providing two vertically extending thin plates that are immersed in the open channel filled with a liquid coating medium (lacquer), whereby the distance between them can be adjusted in an infinitely variable manner. Thus, between the two plates over the entire length of the channel a capillary slot can be obtained with a width that is best suited for the desired capillary effect. Accordingly, the capillary geometry can be adjusted to the various types of plates to be coated.

It is especially advantageous to guide the plate to be lacquered or coated with a uniform and low velocity at a very small distance, for example, less than 0.2 mm, over the upper end of the capillary slot. Accordingly, the lacquer, after exiting from the upper end of the capillary contacts directly the plate surface. Due to an adhesion effect, the lacquer is attached to the plate surface and is carried away from the upper end of the capillary slot with the plate. The result is that the following lacquer, in addition to its upward movement by the capillary effect, is pulled from the capillary slot and, as a function of the velocity of the plate, is deposited in a defined layer thickness on the plate. Due to the adhesion effect of the lacquer at the plate surface there is also no risk that the lacquer, after exiting from the capillary slot, could flow laterally which would result in a decrease of the uniformness of the coating layer.

It is expedient to open the capillary slot between the plates after each lacquering process to between 2 mm and 3 mm. This prevents the automatic (capillary) upward movement of the lacquer, which is undesirable between lacquering processes. It has been shown that during longer residence within the capillary slot the lacquer changes its properties. Such changes are disadvantageous for the lacquering process. However, when the capillary slot is widened to between 2 mm and 3 mm, the lacquer remains unchanged.

Expediently, the slot between the plates is narrowed directly before starting the lacquering process to reach the capillary width. Accordingly, the lacquer located between the plates is in a first step pressed mechanically upwardly until it exits from the upper end of the capillary slot and contacts the plate surface arranged above the capillary slot. Thus, the coating process is started and is commenced due to the capillary effect within the slot that is now of a capillary width, the movement of the plate, and the adhesion effect, as described above.

According to the alternative embodiment of the present invention, it is no longer necessary to guide the plates with a leading corner and at a small upward angle to the horizontal across the lacquering channel. Furthermore, it is no longer required that the liquid coating medium forms a meniscus above the channel (slot) so that supplying the lacquer via a compensation tank becomes obsolete.

DESCRIPTION OF PREFERRED EMBODIMENTS

The present invention will now be described in detail with the aid of several specific embodiments utilizing FIGS. 1 through 6.

FIG. 1 shows a first embodiment of the inventive coating device 10. The channel 12 as well as supports 13 and 14 for the linear transport device 15 are connected to the frame 11. The movable portion of the linear transport device 15 is facing downward. To it a rotatable holder 16 for the plate 17 to be coated is connected. The plate is, for example, a glass plate to be coated with lacquer for use in the subsequent manufacture of a mask or a LCD monitor. The plate 17, for example, is attached to the plate holder 16 by a vacuum suction effect. For this purpose, the holder 16 is provided with non-represented vacuum bores. Within the context of the invention it is also possible to use other holding devices that are known to a person skilled in the art.

Figure 2:
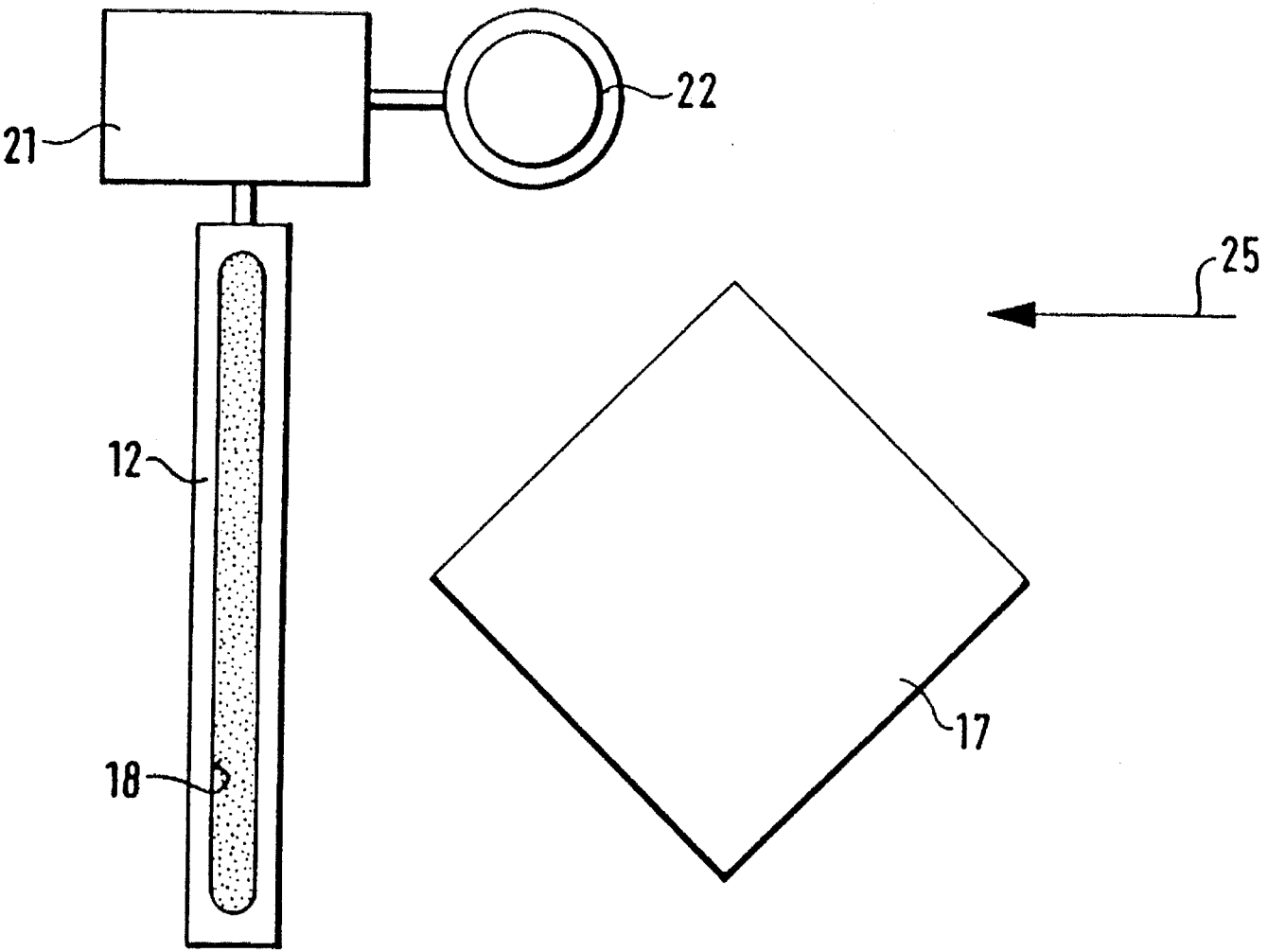
FIG. 2 shows a plan view of the channel of a lacquering and coating device according to FIG. 1 with compensation tank and supply container and a square plate to be coated.
Figure 4:
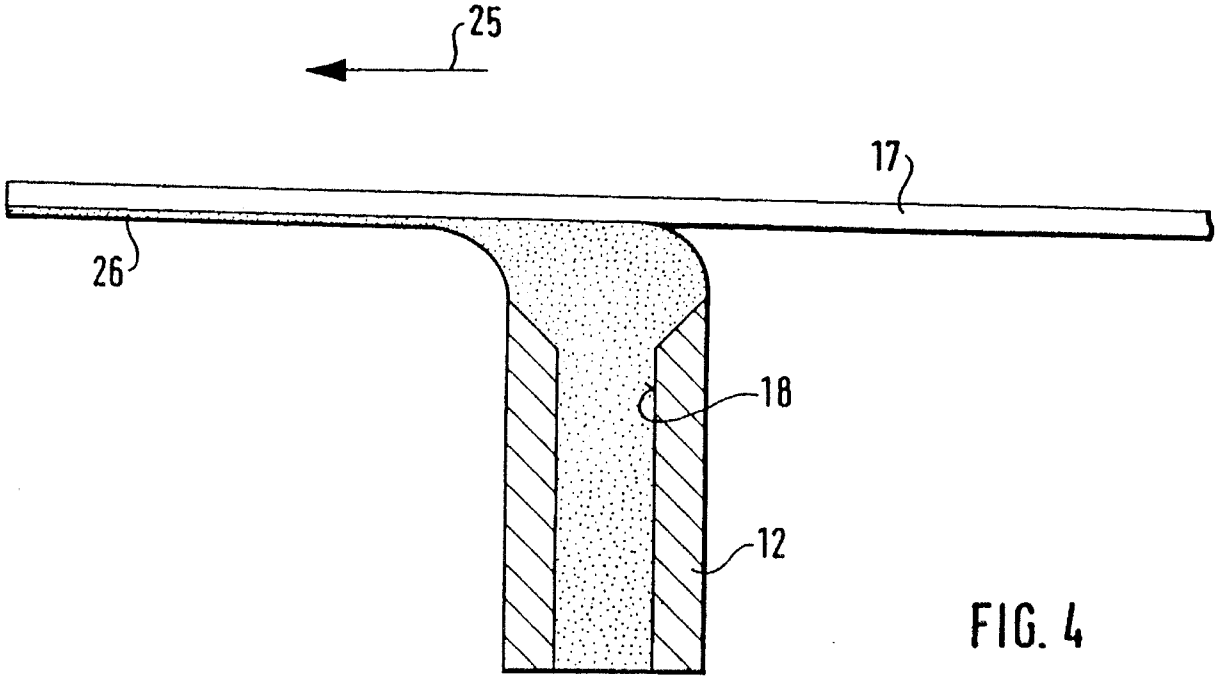
FIG. 4 shows a cross-section of the channel according to FIG. 3 with the plate during the lacquering, respectively, coating process.
Figure 3:
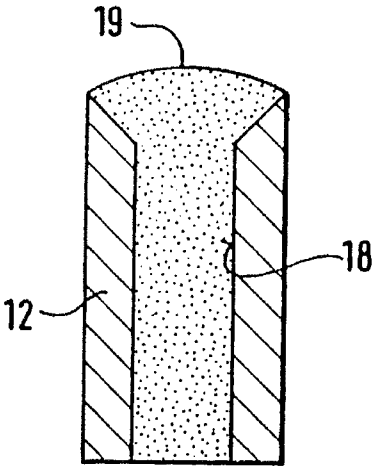
FIG. 3 shows a cross-section of the channel of a lacquering and coating device according to FIG. 1 with the convexly curved portion of the liquid shown.

The channel 12 is shown in a side view in FIG. 1, in a plan view in FIG. 2, and enlarged in FIG. 3 and 4 in a cross-sectional view. The cavity 18 of the channel 12 is filled with lacquer to such an extent that at the upper side of the channel a convexly curved portion 19 projects outwardly from the channel. Accordingly, the plate 17 attached to the holder 16 of the transport device 15 can be guided laterally to the convexly curved portion 19 without the risk of the plate surface contacting the upper edge of the channel 12. This could result in damage to the plate surface and would cancel the result of the coating process.

The supports 13 and 14 of the linear transport device 15 are designed such that they can be adjusted to different heights. This property of the supports is not represented in the drawings. The adjustment of the height can be achieved with various mechanisms that are known to a person skilled in the art. This height adjustment of the supports 13 and 14 allows for the linear transport device 15 to be adjustable within certain limits to desired angles 20 relative to the horizontal. Accordingly, the plate 17 can also contact the convexly curved portion 19 at an angle 20. This is very advantageous for the coating result, as has been explained supra.

The channel 12 is directly connected to the compensation tank 21 (FIG. 2). The filling level of the compensating tank is adjusted before the beginning of the coating process such that in the channel 12 a pressure is achieved which generates the desired convexly curved portion 19. During the coating process, that is when lacquer is being used, the filling level of the compensation tank 21 is maintained at a constant level by a suitably controlled supply from the supply container 22. This is achievable, for example, by a float valve that is, for example, known from carburetors of vehicle engines. However, it is also possible to use other suitable control mechanisms that are known to a person skilled in the art.

For a fully automated version of the coating device at the location indicated at 23 an automatic loading device and at the location indicated at 24 an automatic unloading device are mounted. The loading device removes the plate 17 to be coated from a magazine which is provided at a certain location and guides it to the plate holder 16. The unloading device receives the plate 17 from the holder 16 and transports it to a magazine provided at a certain location.

Function of the First Embodiment of the Lacquering and Coating Device

In a first step, a plate 17 is automatically or manually connected to the holder 16 in a relative position to the channel 12 represented in FIG. 2. By rotating the holder 16 this position can be corrected. The holder, at this point, is in the vicinity of the location that is indicated at 23 in FIG. 1. When the plate 17 is correctly positioned at the holder 16, the linear transport device 15 is moved in the direction of arrow 25, that is, in direction toward the channel 12.

The coating of the plate 12 begins as soon as its most forward point contacts the convexly curved portion 19. Subsequently, the connection of plate and lacquer as represented in FIG. 4 is achieved. The plate 17 moving in the direction of arrow 25 deforms the convexly curved portion in its direction of movement until a force equilibrium between liquid adhesion at the plate 17 and liquid cohesion within the channel 12 is generated. Subsequently, a thin liquid layer 26 (FIG. 4) is continuously deposited on the plate while the removed mass flow of liquid is replaced within the channel 12.

The coating process is terminated as soon as the connection between the plate 17 and the liquid flow from the channel 12 is interrupted at the rearmost point of the plate 17. The plate 17 is then moved into the area indicated at 24 where it is automatically or manually removed from the holder 16.

Figure 5:
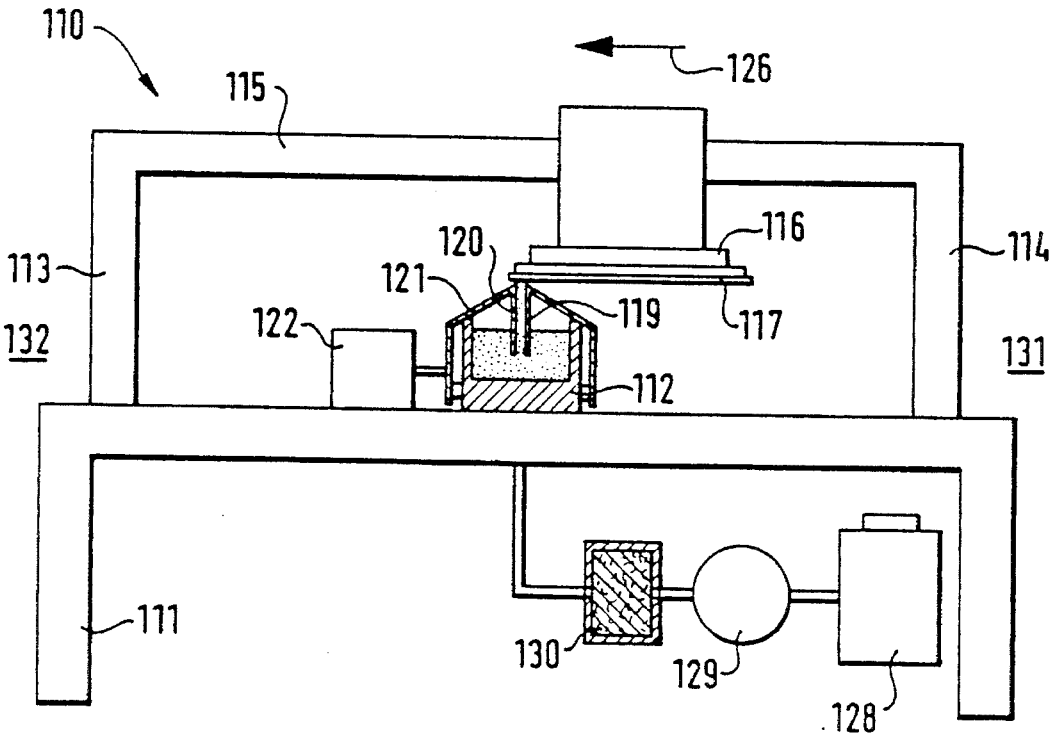
FIG. 5 shows a side view of the inventive design of a lacquering and coating device.

FIG. 5 shows a second embodiment of the inventive coating device 110. To a frame 111 the channel 112 as well as the supports 113 and 114 of the linear transport device 115 are connected. The movable portion of the linear transport device 115 faces downwardly. Connected to it is a rotatable holder 116 for the plate (substrate) 117 to be coated. The plate 117 is, for example, a glass plate to be coated with a lacquer in order to be used subsequently for the production of a mask or an LCD monitor. The plate 117 is, for example, supported by vacuum at the plate holder 116. For this purpose, the holder 116 is provided with respective vacuum bores, that are not represented in the drawing. Within the context of the invention it is conceivable to use other holding devices whose design and construction are known to a person skilled in the art.

Figure 6:
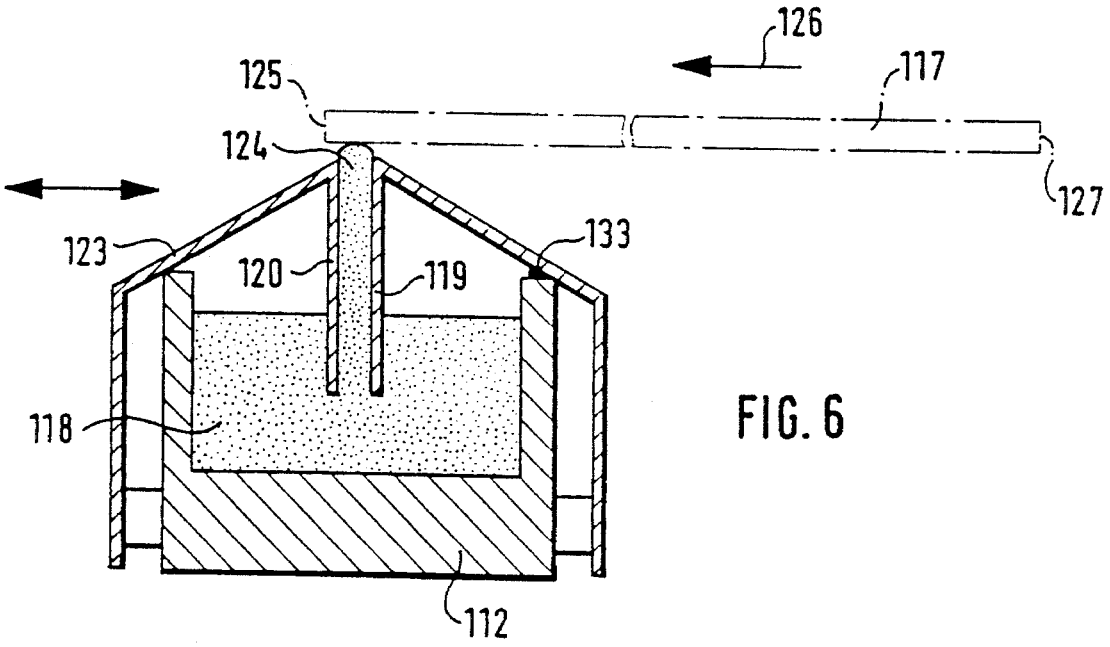
FIG. 6 shows a cross-section of the channel with capillary slot according to FIG. 1 at the beginning of a coating process.

The channel 112 is represented in cross-section in FIG. 5 and, in detail, in FIG. 6. The hollow interior (cavity) 118 of the channel 112 is partially filled with lacquer. Two thin parallel plates 119 and 120 are immersed in this lacquer. The plate 119 is fixedly connected at the location 133 to the upper edge of the channel 112. It is not displaceable. On the other hand, the plate 120 is connected with a suitable device to a linear displacement unit 122. Via this displacement unit 122, the plate 120 can be moved back and forth in the direction of the arrow 123. Accordingly, the width of the slot 124 between the parallel plates 119 and 120 can be adjusted in an infinitely variable manner.

For achieving optimal lacquering or coating results, the corresponding liquid coating medium (lacquer) must have a certain temperature and must be very clean. Accordingly, it is supplied from a supply tank 128 via a temperature control unit 129 and a filter 130 to the channel 112. The conveying of the liquid medium can be achieved by generating a pressure (gas cushion) within the supply tank or by providing a suitable arrangement of the supply tank so that the liquid is conveyed by the geodetical height difference to the channel. However, any other suitable device, known to a person skilled in the art, for transporting the liquid is conceivable.

For a fully automated version of the coating device, at the location indicated at 131 an automated loading device and at the location 132 an automated unloading device are provided. The loading device (at 131) removes the plate 117 to be coated from a magazine connected to the frame and conveys the plate to the plate holder 116. The unloading device (132) removes the plate 117 from the holder 116 and loads it into another magazine connected to the frame.

Mode of Operation of the Second Embodiment of the Lacquering and Coating Device In a first step, the plate 117 is automatically or manually connected to the holder 116. By rotating the holder 116 its position can be corrected. The plate holder 116 at this time is located at the location indicated at 131 in FIG. 5. After the plate has been correctly positioned at the holder 116, the linear transport device 115 is set in motion in the direction of arrow 126, i.e., in direction toward the channel 112.

Plate 117 is thus advanced from the side to the upper edge of the slot 124. As soon as the leading edge 125 of the plate 117 is positioned directly above the slot 124, the plate 120 within the channel 112 is advanced toward the plate 119 such that a suitable capillary width is provided between the plates i.e., the slot becomes a capillary slot. Due to the narrowing of the slot 124 a small amount of liquid is forced out of the capillary slot 124 against the leading edge of the plate 117 to be coated. Thus the coating process has begun. The plate 117 is now advanced further at a uniform velocity via the linear transport device 115 in the direction of arrow 126. Due to the adhesion effect a thin liquid layer is deposited on the plate surface. The required stream of liquid is supplied by the capillary effect within the capillary slot 124.

The coating process is terminated as soon as the rear edge 127 of the plate 117 passes the capillary slot 124. The two plates 119 and 120 are now moved apart to a distance of 2 to 3 mm for the aforementioned reasons until the next coating process is to be performed. The plate 117 is advanced to the location indicated at 132 where it is automatically or manually removed from the holder 116.

The present invention is, of course, in no way restricted to the specific disclosure of the specification and drawings, but also encompasses any modifications within the scope of the appended claims.

What we claim is:

1. A method for coating a series of plates substrates sequentially, said method comprising the steps of:

a) providing a channel and filling said channel with a liquid coating medium;

b) arranging in said channel two parallel means for forming therebetween a capillary slot;

c) immersing said two parallel means in the liquid coating medium contained in said channel;

d) decreasing a distance between said parallel means to a capillary width to form said capillary slot and to press an amount of the liquid coating medium out of said capillary slot;

e) advancing a plate with a surface to be coated facing said capillary slot across said capillary slot;

f) depositing a film of the liquid coating medium on the plate by a capillary effect of said capillary slot and by adhesion;

g) after said step of depositing enlarging a distance between said parallel means to cancel the capillary effect of said capillary slot in order to preserve the liquid coating medium; and h) repeating the steps d) through g).

2. A method according to claim 1, wherein the plate is an angular plate with corners, said method further comprising the step of advancing the plate past said capillary slot with one of said corners leading.

3. A method according to claim 1, further comprising the step of arranging the plate at an angle greater than 0° relative to the horizontal during the step of depositing.

4. A method according to claim 1, further comprising the steps of:

arranging a linear transporting device with an adjustable slant above said capillary slot; and suspending the plate from the linear transporting device with the surface to be coated facing in a downward direction.

5. A method according to claim 1, further comprising the step of maintaining a selected filling level of the channel.

6. A method according to claim 5, further comprising the steps of:

maintaining the filling level constant by hydrostatic pressure from a compensation tank; and refilling the compensation tank from a supply container.

7. A method according to claim 1, further comprising the step of arranging in a direction of guiding the plate an automatic loading station upstream of said capillary slot and an automatic unloading station downstream of capillary slot for performing said method in a fully automated manner.

8. A method according to claim 1, further comprising the steps of:

supporting the plate on a holder; and moving said capillary slot relative to said holder so that the step of coating is performed with said holder being stationary and said capillary slot being moved across the plate.

* * * * *